US006899688B2

(12) United States Patent
Wu

(10) Patent No.: US 6,899,688 B2
(45) Date of Patent: May 31, 2005

(54) CERVICAL VERTEBRA MASSAGING DEVICE WITH ROLLER SETS

(76) Inventor: Dong-Her Wu, 235 Chung-Ho Box 8-24, Taipei (TW)

( * ) Notice: Subject to any disclaimer, the term of this patent is extended or adjusted under 35 U.S.C. 154(b) by 134 days.

(21) Appl. No.: 10/277,777

(22) Filed: Oct. 23, 2002

(65) Prior Publication Data

US 2004/0082889 A1 Apr. 29, 2004

(51) Int. Cl.[7] ..... A61H 15/00

(52) U.S. Cl. ..... 601/99; 601/100; 601/102; 601/116

(58) Field of Search ..... 601/86, 87, 90, 601/93, 98, 99, 100, 102, 103, 115, 89, 94, 97, 107, 111, 116

(56) References Cited

U.S. PATENT DOCUMENTS 4,458,675 A * 7/1984 Nakao et al. ..... 601/102
5,385,531 A * 1/1995 Jover ..... 601/99
6,200,282 B1 * 3/2001 Furuie et al. ..... 601/98
6,623,438 B1 * 9/2003 Wu ..... 601/99
6,681,770 B1 * 1/2004 Dreher ..... 601/103

* cited by examiner

*Primary Examiner*—Justine R. Yu
*Assistant Examiner*—Quang D. Thanh

(57) ABSTRACT

A cervical vertebra massaging device with roller sets comprises a driving device driving a driven seat to move reciprocally; a main axial rod protruding from the driven seat; two axial seats; each of two sides of the main axial rod being connected to a middle section of a respective one of two axial seats; two sides of each axial seat being locked with one sub axial rod; each sub axial rod being installed with one roller set. Each ends of the axial seat is protruded with a respective sliding head which is aligned to and resists against the track and then can slide therein; at a distal end of the track is installed with a protruding slope. When the driving device moves, the roller sets moves along the back of the user, and thus give a comfortable massage to the user.

2 Claims, 6 Drawing Sheets

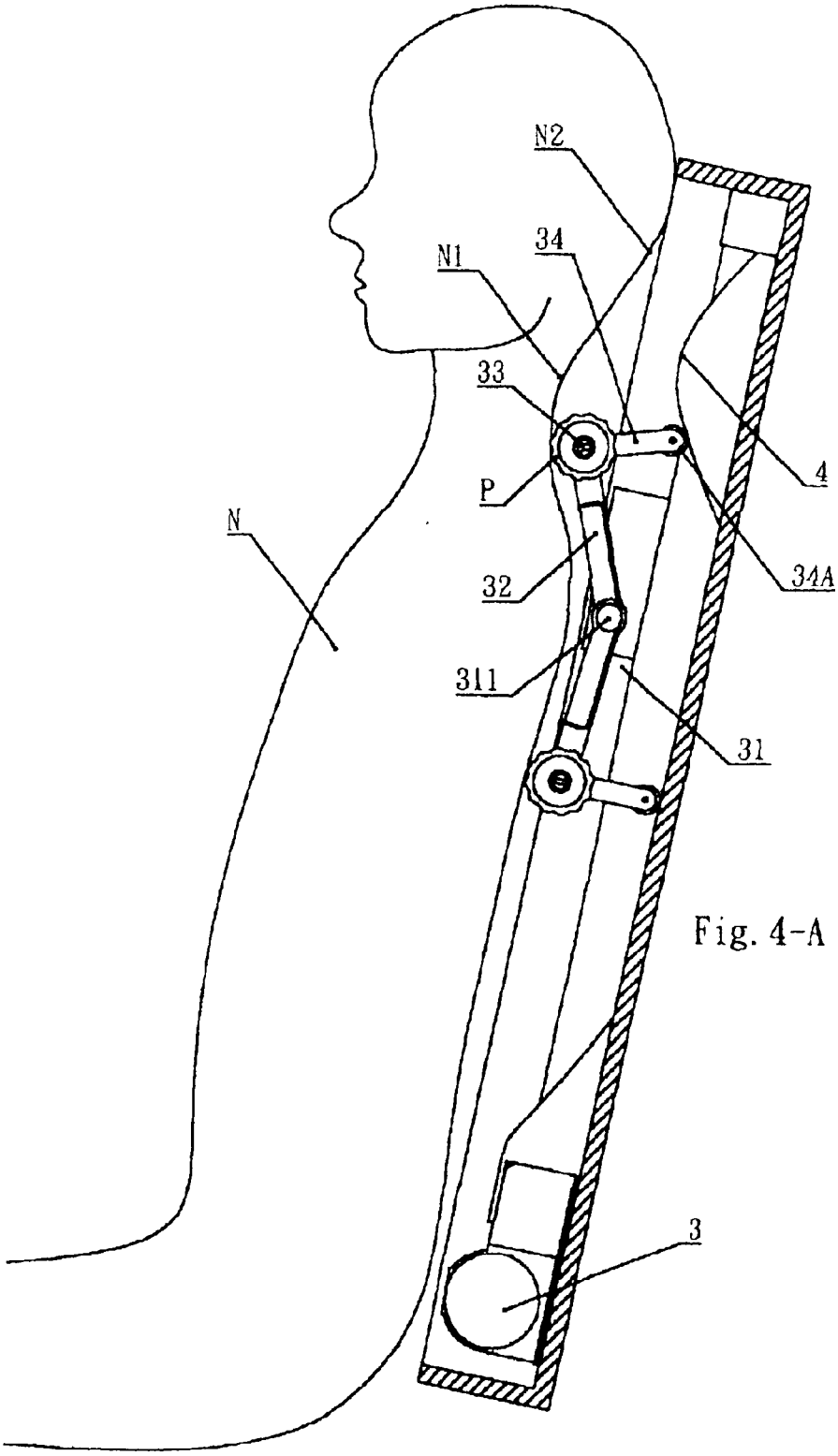
Fig. 4-A

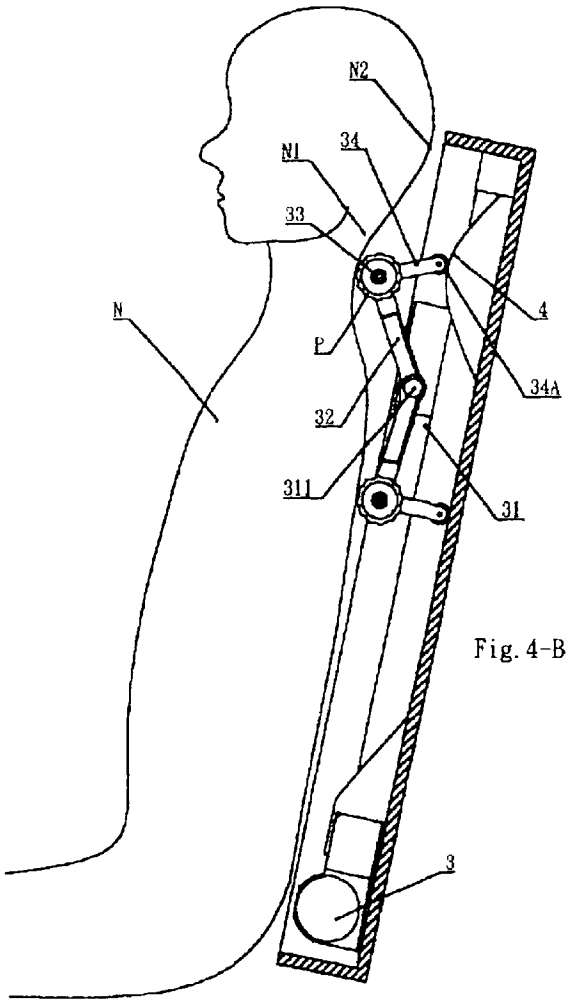
Fig. 4-B

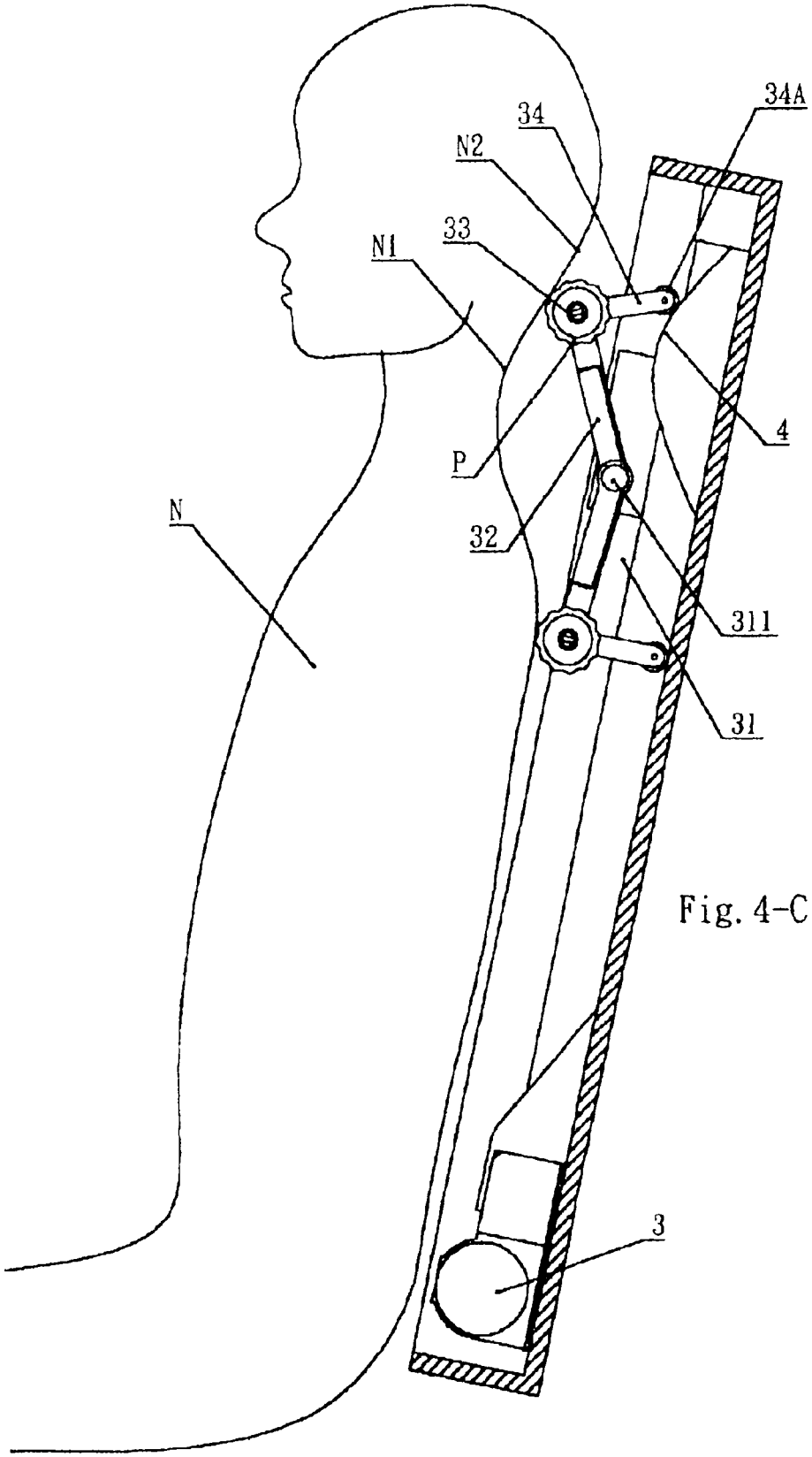
Fig. 4-C

CERVICAL VERTEBRA MASSAGING DEVICE WITH ROLLER SETS

FIELD OF THE INVENTION

The present invention relates to cervical vertebra massage devices, and particularly to a cervical vertebra massaging device with roller sets which provides a traveling path matched to the shape of user's cervical vertebra.

BACKGROUND OF THE INVENTION

Referring to FIG. 1, a massage device assembled at a chair or an inner part of a pad for massaging the back of a user is illustrated. To massage the whole back side, the massage device must move reciprocally by being driven by a driving device 2 (referring to FIG. 2). In this example, a driving device 2 of a bi-directional screw rod is used for description. The driving device 2 has a driven seat 21 and a single axial level form roller sets P at a lateral side thereof. When the roller sets P are carried by the driven seat 21 to move reciprocally, the back of the user is massaged.

However, in the prior art, the roller sets P have respective sliding heads 22. The roller sets P move along a smooth path with two ends of the path having respective taper sections 23. The taper sections 23 are used to suit the waist and cervical vertebra portions of the user. In that prior art, as shown in the figures, the taper sections are protruding slopes and the roller sets P return as the sliding heads 22 reach the high place of the taper sections 23.

In fact, the roller sets P returns before the sliding heads 22 reach the highest points of the taper sections 23 for preventing other elements to be damaged or buckled.

From the shape of human body, it is appreciated that human's waist and cervical vertebra has stream line shapes, but the prior art design is not matched to the ergonomics so that the user will feel uncomfortable. Especially the taper section 23 will cause the user to feel ache in the cervical vertebra portion and the back side of the user's head does not be massaged.

For these reasons, many prior arts does not design the taper sections 23 in their massage device, but this still remains the problem unsolved. Thus the prior art design can not make the users feel easy and the massage device can not function satisfactory.

SUMMARY OF THE INVENTION

Accordingly, the primary object of the present invention is to provide a cervical vertebra massaging device with roller sets comprising a driving device driving a driven seat to move reciprocally; a main axial rod protrudes from the driven seat; two axial seats; each of two sides of the main axial rod being connected to a middle section of a respective one of two axial seats; two sides of each axial seat being locked with one sub axial rod; each sub axial rod being installed with one roller set. Each ends of the axial seat is protruded with a respective sliding head which is aligned to and resists against the track and then can slide therein; and at a distal end of the track is installed with a protruded protruding slope. When the driving device moves, the roller sets move along the back of the user; and the roller sets move into the protruding slope at a distal end of the track, the roller sets will move along the protruding slope so as to have a path like the cervical vertebra of a user. Thereby, give a comfortable massage to the user.

Another object of the present invention is to provide a cervical vertebra massaging device with roller sets, wherein a lower edge of the sliding head below the axial seat has a sliding wheel for increasing the smoothness in the traveling process.

A further object of the present invention is to provide a cervical vertebra massaging device with roller sets, wherein above mention protruding slope is detachably installed by locking or embedded; and thus the protruding slope is adjustable so as to meet the requirement of the user.

The various objects and advantages of the present invention will be more readily understood from the following detailed description when read in conjunction with the appended drawing.

BRIEF DESCRIPTION OF THE DRAWINGS

FIGS. 4A to 4C are schematic views showing the continuous actions of the roller sets of the present invention.

BRIEF DESCRIPTION OF THE PREFERRED EMBODIMENTS

Figure 1:
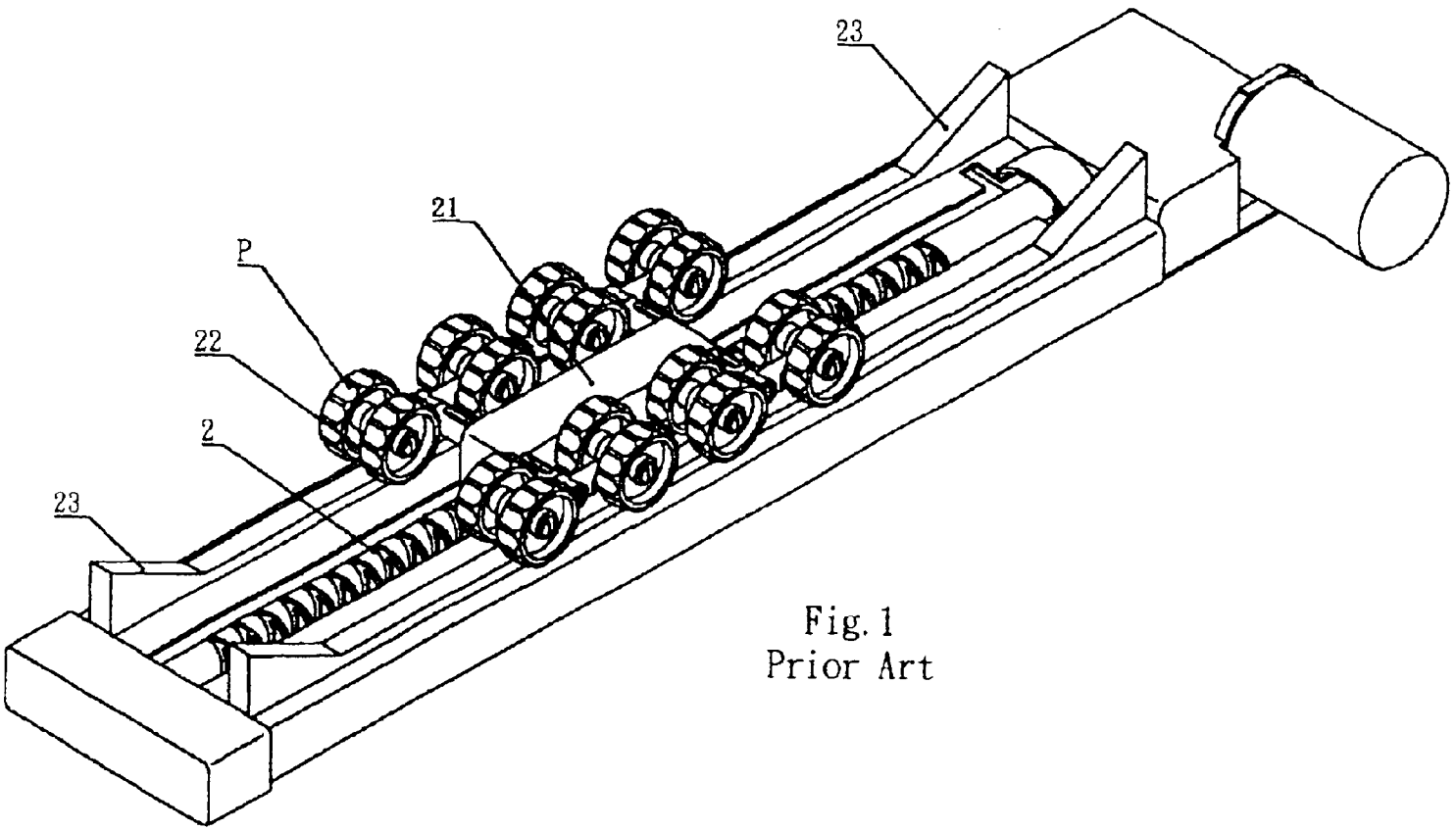
Fig. 1 Prior Art
FIG. 1 is a schematic view of a prior art.
Figure 2:
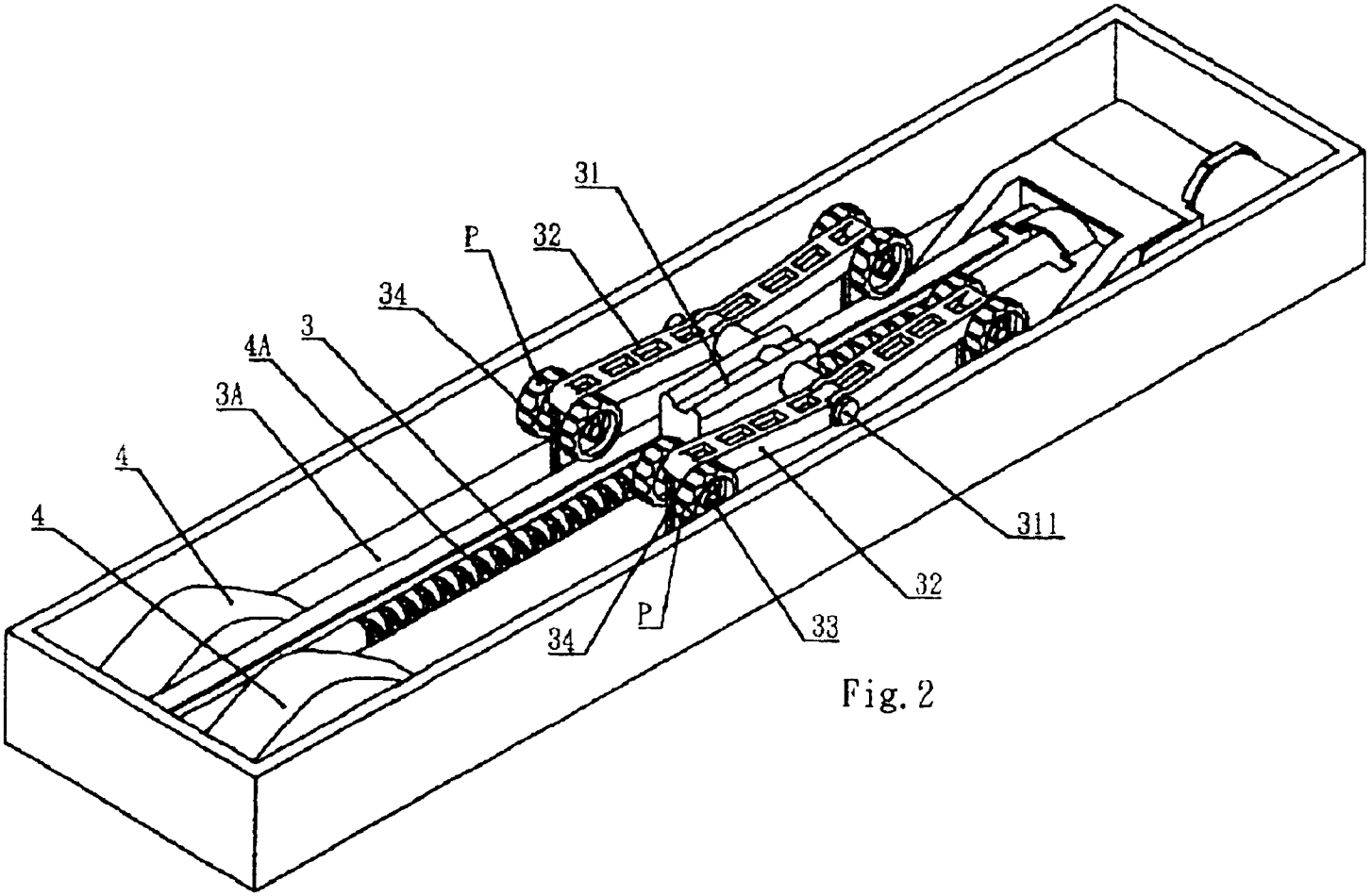
FIG. 2 is a schematic view showing one embodiment of the present invention.
Figure 3:
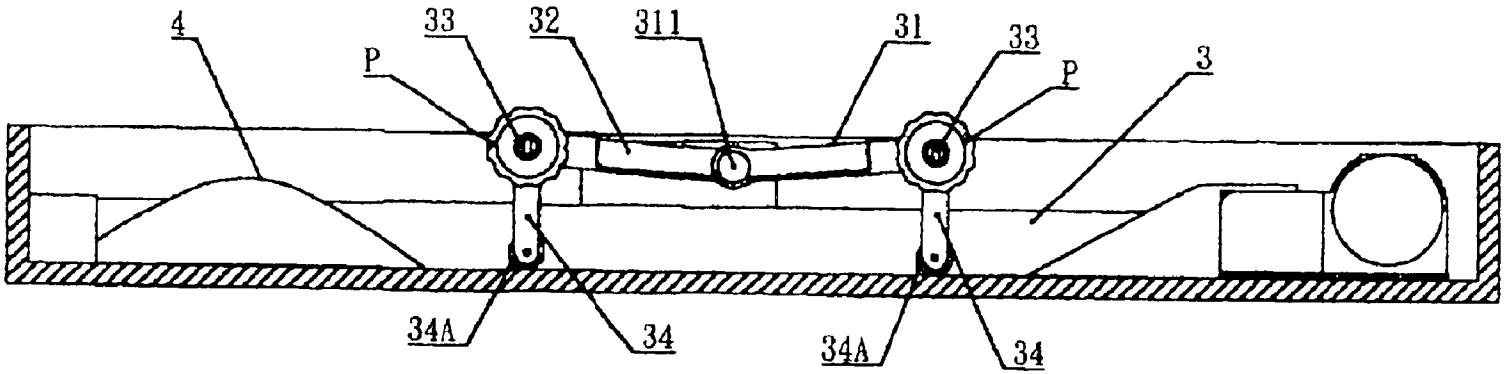
FIG. 3 is a schematic cross sectional view of the present invention.

The features, structure, functions and objects of the present invention will be described herein with reference to FIGS. 2 and 3. In the massage device of the present invention, the driving device 3 drives the driven seat 31 to move reciprocally. A main axial rod 311 protrudes from the driven seat 31. Each of two ends of the main axial rod 311 is connected to a middle section of a respective one of two axial seats 32. Two sides of each axial seat 32 are locked with a sub axial rod 33. Each sub axial rod 33 is installed with one roller set P. Thereby, a single axial seat 32 with two roller sets P is formed (However, a single axial seat 32 with a level can be used, but here, the single axial seat 32 with two roller sets P is used in description).

Each end of the axial seat 32 is protruded with a respective sliding head 34 which is aligned to and resists against the track 4A and then can slide therein. At a distal end of the track 4A is installed with a protruding slope 4, wherein the protruding slope 4 has an upward slope near a middle section of the driving device 3 and a downward slope connected to the upward slope and far away from a middle section of the upward slope. By above structure, a message roller unit of the present invention is formed.

By this structure, when the driving device 3 moves, the roller sets P move along the back of the user N (referring to FIG. 4A). When the roller sets P move into the protruding protruding slope 4 at a distal end of the track 4A, the roller sets P will move upwards along the slope of the protruding slope 4 and then move to the apex of the sliding head 34. Then the roller sets P slides downwards along the protruding slope 4. Thereby, the traveling path of the roller sets P is along the shape of the cervical vertebra of the user (referring to FIG. 4B).

When the roller sets P pass through a top of the protruding slope 4, the user N applies a force to the roller sets P and by an auxiliary spring (not shown)) of the axial seats 32, the roller sets P moves downwards to a lowest point of the protruding slope 4. Therefore, the roller sets P move along the back side of the head of the user smoothly (referring to FIG. 4C).

When the roller sets P move along a reverse path, the same travelling trace is passed as described above, but the direction of the movement is reversed. Thereby, by the special arrangement of the present invention, the back side and cervical vertebra of the user are fully massaged.

In the present invention, a lower edge of the sliding head 34 below the axial seat 32 has a sliding wheel 34A (referring to FIG. 3) for increasing the smoothness in the traveling process, while the sliding wheel does not affect the massage effect of the roller sets P.

However, the above mention protruding slope 4 can be installed at other portion of the track 4A by locking or embedded, etc. Moreover, the protruding slope 4 is adjustable so as to meet the requirement of the user.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A cervical vertebra massaging device with roller sets comprising: a driving device driving a driven seat to move reciprocally a main axial rod protruding from the driven seat; two axial seats; each of two sides of the main axial rod being connected to a middle section of a respective one of two axial seats; two sides of each axial seat being locked with one sub axial rod; each sub axial rod being installed with one roller set; a track is formed along the driving device;

characterized in that:

each ends of the axial seat is protruded with a respective sliding head which is aligned to and resists against the track and then can slide therein; at a distal end of the track is installed with a protruding slope; wherein the protruding slope has an upward slope near a middle section of the driving device and a downward slope connected to the upward slope and far away from the middle section of the upward slope;

wherein when the driving device moves, the roller sets moves; and the roller sets move into the protruding slope at a distal end of the track, the roller sets will move along the protruding slope so as to have a path like the cervical vertebra of a user, and thereby, a comfortable message is provided to the user.

2. The cervical vertebra messaging device with roller sets as claimed in claim 1, wherein a lower edge of the sliding head below the axial seat has a sliding wheel for increasing the smoothness in the travelling process.

* * * * *